US006015257A

United States Patent [19]

Hahne et al.

[11] Patent Number: 6,015,257

[45] Date of Patent: Jan. 18, 2000

[54] DEVICE FOR FORMING A STACK ON A TRANSPORT TABLE

[75] Inventors: Ernst August Hahne, Allschwil, Switzerland; Hermann Kunzig, Weil am Rein, Germany

[73] Assignee: Eltexelektrostatik GmbH, Weil Am Rhein, Germany

[21] Appl. No.: 08/945,043

[22] PCT Filed: Oct. 5, 1995

[86] PCT No.: PCT/EP95/03939

§ 371 Date: Oct. 20, 1997

§ 102(e) Date: Oct. 20, 1997

[87] PCT Pub. No.: WO96/33119

PCT Pub. Date: Oct. 24, 1996

[30] Foreign Application Priority Data

Apr. 19, 1995 [DE] Germany ..... 195 14 405

[51] Int. Cl.[7] ..... B65H 31/34

[52] U.S. Cl. ..... 414/788; 414/788.9

[58] Field of Search ..... 414/788, 788.1, 414/788.9, 794.4; 271/208

[56] References Cited

U.S. PATENT DOCUMENTS

| | | | |
|---|---|---|---|
| 3,834,290 | 9/1974 | Nelson | 414/789.1 |
| 4,765,791 | 8/1988 | Brandt et al. | 414/788 |
| 5,062,764 | 11/1991 | Welsch | 414/796 |
| 5,228,373 | 7/1993 | Welsch | 271/208 |
| 5,868,546 | 2/1999 | Hahne et al. | 414/788 |

FOREIGN PATENT DOCUMENTS

| | | | |
|---|---|---|---|
| 40 00 263 | 7/1991 | Germany | 414/788 |

*Primary Examiner*—Christopher P. Ellis
*Assistant Examiner*—Douglas Hess
*Attorney, Agent, or Firm*—Antonelli, Terry, Stout & Kraus, LLP

[57] ABSTRACT

A device for stacking objects, such as newspapers, magazines, or other stackable paper objects, on a transport table for further conveyance to another processing station, whereby the device includes a blocking device with at least one blocking device on each side of the stack and at least one charging device upstream of the blocking device for charging each object before it is stacked.

10 Claims, 2 Drawing Sheets

DEVICE FOR FORMING A STACK ON A TRANSPORT TABLE

The invention relates to a device for forming a stack on a transport table.

A device of this kind is known of itself and serves for example for stacking newspapers, magazines, or the like from a so-called stacker to a shrinking station, especially for films.

As a result of the application of the binding of the magazines and insertion of uneven enclosures, such stacks of magazines, when they emerge from the stacker and during transport to the shrinking station, have a tendency to slide or even fall over. For this reason, blocking devices have already been provided that charge the two lateral areas, reducing the risk of sliding. Stacking robots can then not be used downstream from the stacker when a stack is present which has slipped and cannot be received.

The invention is based on the goal of aligning the piled stack of objects in a more stable fashion in a device according to the invention.

According to the invention, before the objects reach the stack they are charged by a separate charging device, with an opposite polarity already being present in the stack relative to the side areas of the stack that face away from one another and are charged with an electrostatic charge by the charging electrodes, said lateral areas being aligned perpendicularly to the transport direction. Since the paper stack has a dielectric constant higher than that of air, the electrical field concentrates in this area. In addition to this concentration, there is also a field concentration in the superfluous air inclusions in the stack so that the action of the field force in the stack and the accumulated charge on the surface force the air out of the stack. This results in considerably greater adhesion of the copies to one another, causing the stack to be mechanically blocked and consequently held together. This assumes that the transport table is grounded so that the electrical field is directed in the form of an arc from each lateral area to the transport table.

In an advantageous embodiment of the invention, the finished stack is not charged with a polarity by means of the two laterally disposed charging electrodes but is additionally charged on the top, which is opposite the transport table, by an additional charging electrode with reversed polarity so that the locking effect can be still further improved. Especially advantageously, the charging device has at least one endlessly circulating conveyor belt on whose upper run the objects can be supplied, and the reversal of the conveyor belt takes place on the outflow side above the transport table. The upper run of the conveyor belt has associated with it a second additional charging electrode that extends transversely to the transport direction of the conveyor belt. In addition, another endlessly circulating conveyor belt can be associated with the first conveyor belt, having its lower run associated with the upper run of the conveyor and operating at the same speed. In this way, a discharge electrode is advantageously associated with the upper run of the additional conveyor.

Further advantageous embodiments and improvements on the invention are characterized in the subclaims.

One preferred embodiment will be described in greater detail below with reference to the drawing.

Figure 1:
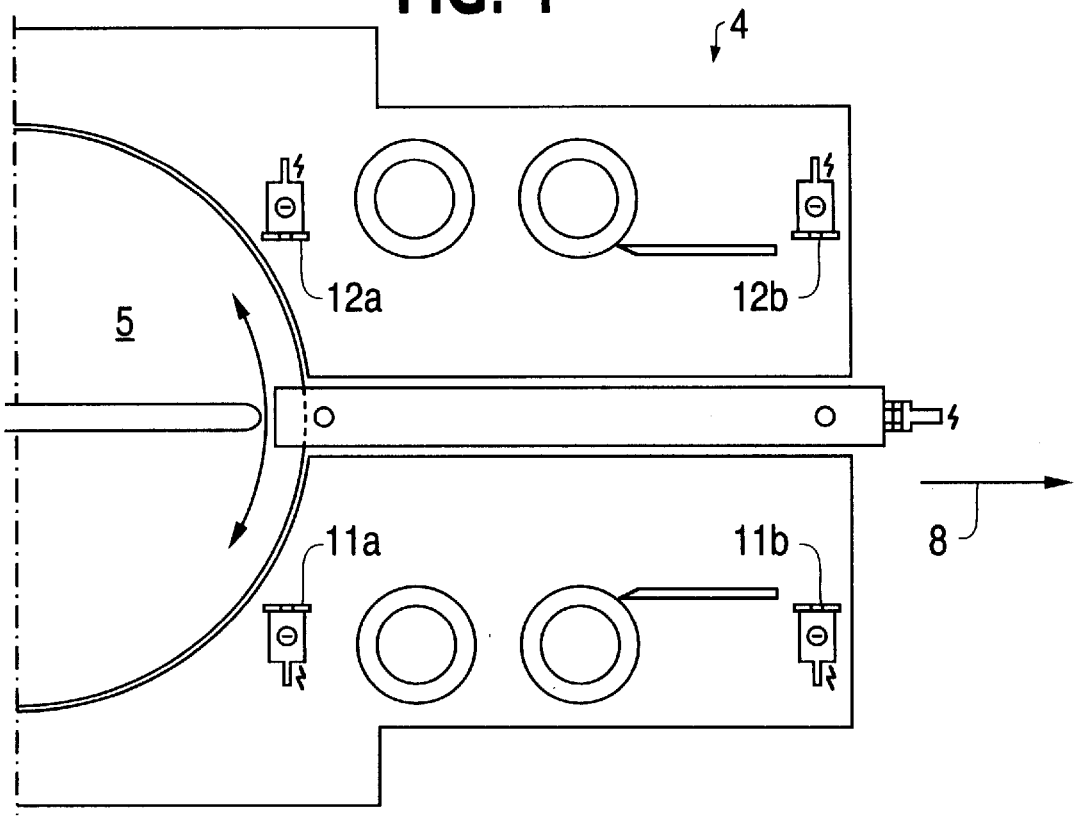
FIG. 1 is a schematic top view of a device for forming a stack of magazines by means of a stacker.

FIG. 1 shows a blocking device 4 and a stacker, represented as a whole by 5, in schematic form. With this stacker, a stack that is represented as a whole by 6 (FIG. 2) and is composed of magazines is laid down on the transport table, represented as a whole by 7. This stack 6 is then conveyed in transport direction 8 (FIG. 1) to the next workstation, a shrinking station for example, where the stack is wrapped in film and then sealed, or shrunk by means of shrink film.

To produce a mechanical intrinsic stiffness of stack 6, the latter is blocked electrostatically. For this purpose, at the two lateral surfaces 9 and 10 of stack 6 in the embodiment shown, two charging electrodes 11*a,* 11*b* are provided on one side and two more 12*a,* 12*b* on the other. These charging electrodes extend perpendicularly to transport direction 8 and extend perpendicularly to transport table up to the full height of stack 6, specifically on its two sides 9 and 10. In this way, the two sides are charged with negative polarity.

In addition, another charging electrode 13 is provided above stack 6 and parallel to the transport direction, said electrode being located on top 14 of the stack that is opposite transport table 7, near its surface,.

Instead of the alignments and the arrangements of the electrodes as in the embodiment described above, it is also possible to place the lateral electrodes transversely, for example diagonally with respect to the lateral surfaces of the stack, or at right angles or transversely or diagonally on the top of additional electrode 13. The other charging electrode 13 is charged with opposite polarity relative to charging electrodes 11 and 12.

Figure 2:
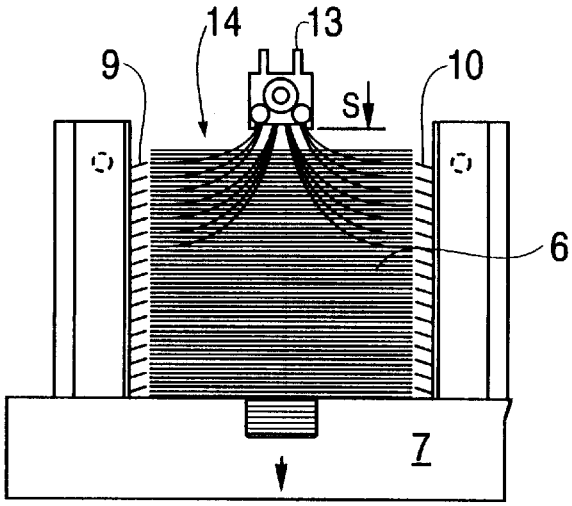
FIG. 2 shows a front view of the device according to FIG. 1.
Figure 3:
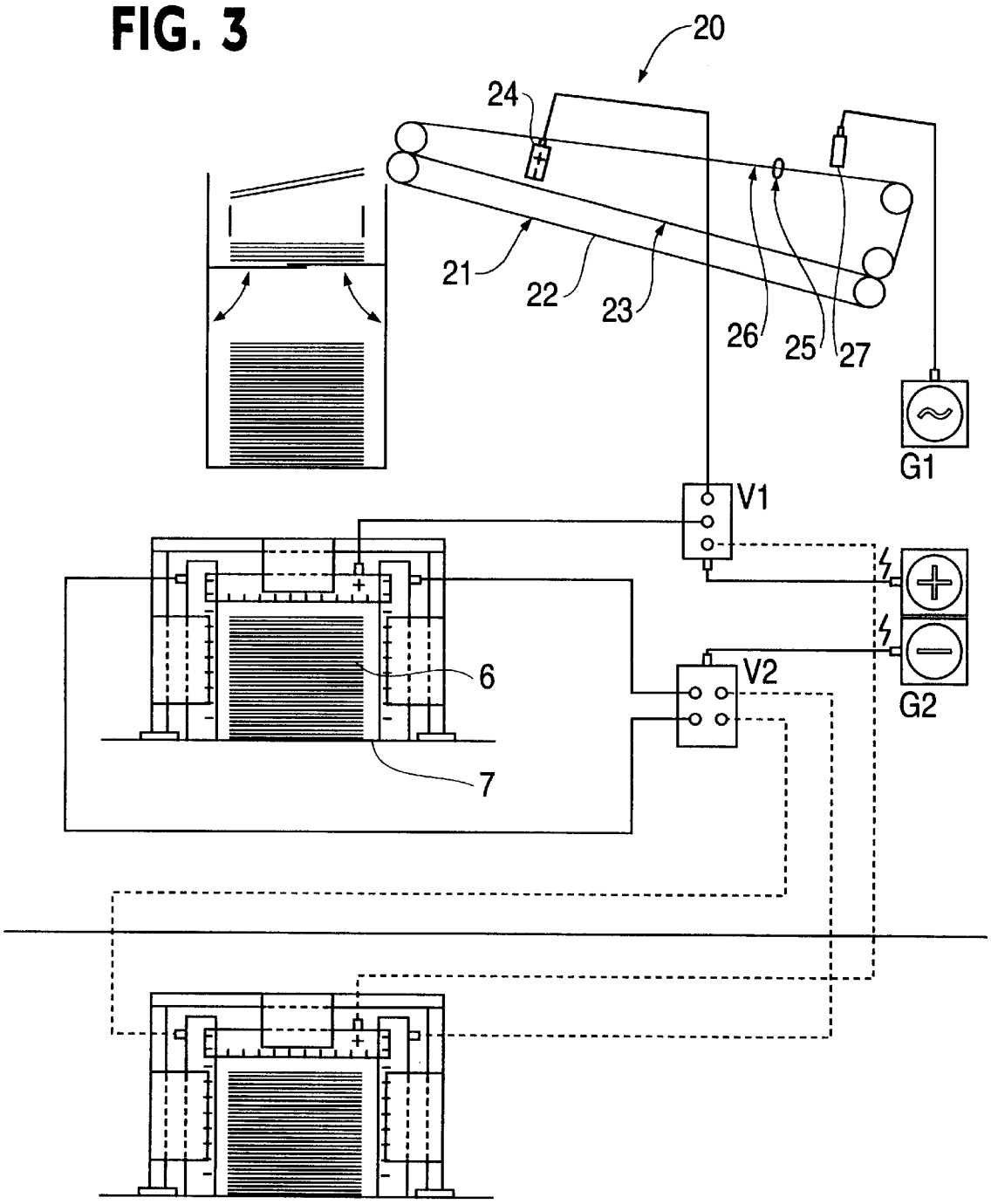
FIG. 3 is a schematic view of the entire device.

Upstream of the blocking device 4 shown in FIGS. 1 and 2, a charging device 20 is provided as shown in FIG. 3. This device has at least one conveyor 21 in the form of an endlessly-circulating conveyor belt 22 on whose upper run 23 the objects can be supplied. Conveyor belt 22 is reversed on the outflow side above transport table 7. A second additional charging electrode 24 extending transversely to the transport direction is associated with upper run 23 of conveyor belt 22, by means of which electrode 24 the objects transported on the upper run can be charged.

Another circulating conveyor belt 25 of a second conveyor 26 is associated with the first conveyor, with its lower run being associated with the upper run of conveyor 21 and traveling at the same speed. This upper run has associated with it a discharging electrode 27 that likewise preferably extends transversely to its direction of circulation. By virtue of this device, objects are transported between the two runs to the delivery point and charged as a result by the second additional charging electrode 24.

We claim:

1. Device for forming a stack (6) of objects to be transported further on a table (7) in a transport direction (8), said objects being stacked newspapers, magazines, or other stackable paper products, with the stack being transported further to another workstation, Characterized in that a blocking device is provided for a stack (6) to pass through, whereby the blocking device has at least one charging electrode (11*a,* 11*b,* 12*a,* 12*b*) for locating on each side in transport of a transported stack whereby the blocking device is for providing a more stable stack, further characterized in that a charging device is located upstream of said blocking device, whereby the charging device is for electrostatic charging of each object before it reaches the stack.

2. Device according to claim 1, characterized in that at least two charging electrodes (11, 12) are provided on the same side and have the same polarity.

3. Device according to claim 2, characterized in that at least one additional charging electrode (13) with a polarity opposite to that of the at least two charging electrodes is located above the stack.

4. Device according to claim 3, characterized in that the at least one additional charging electrode (13) has positive polarity.

5. Device according to claim 3, characterized in that the at least two charging electrodes (11, 12) and the at least one additional charging electrode (13) are located essentially transversely with respect to transport direction (8).

6. Device according to claim 1, characterized in that the table is capable of being a transporting table and capable of being grounded.

7. Device according to claim 1, characterized in that charging device (2) comprises at least a first conveyor (21) in the form of an endlessly circulating conveyor belt (22) on whose upper run (23) the objects can be supplied and in that the circulating conveyor belt (22) is reversed at its output end above the table (7).

8. Device according to claim 7, characterized in that the upper run of the first conveyor belt has a charging electrode (24) that extends transversely to its transportation direction.

9. Device according to claim 7, characterized in that the the charging device has associated with it an additional endlessly circulating conveyor belt (25) of a second conveyor (26) whose lower run is associated with the upper run of the first conveyor (21) and travels at the same speed as the first conveyor.

10. Device according to claim 9, characterized in that a discharging electrode (27) is positioned adjacent the upper run of the second conveyor (26).

* * * * *